US006132189A

United States Patent [19]

Ward

[11] Patent Number: 6,132,189

[45] Date of Patent: Oct. 17, 2000

[54] COMBINED BICYCLE TIRE AND AIR SUSPENSION PUMP WITH REMOVABLE PRESSURE GAUGE

[75] Inventor: Adrian Roger Ward, Oxon, United Kingdom

[73] Assignee: A-Pro Cycles, Inc., Taichung Hsien, Taiwan

[21] Appl. No.: 09/534,075

[22] Filed: Mar. 24, 2000

[51] Int. Cl.[7] ..... F04B 19/02

[52] U.S. Cl. ..... 417/521; 417/469; 417/487; 417/467

[58] Field of Search ..... 417/460, 467, 417/468, 487, 521, 544, 570

[56] References Cited

U.S. PATENT DOCUMENTS

| | | | |
|---|---|---|---|
| 1,381,115 | 6/1921 | Gassenhuber, Jr. | 417/467 |
| 1,424,928 | 8/1922 | McClelland | 417/467 |
| 5,443,370 | 8/1995 | Wang | 417/238 |
| 5,779,457 | 7/1998 | Chuang et al. | 417/467 |
| 6,027,316 | 2/2000 | Wang | 417/307 |

*Primary Examiner*—Charles G. Freay
*Assistant Examiner*—Robert Z. Evora
*Attorney, Agent, or Firm*—Rosenberg, Klein & Lee

[57] ABSTRACT

A pump includes a first cylinder with a first valve member connected to a first end of the first cylinder and a first handle disengagably connected to a second end of the first cylinder. A first piston is movably received in the first cylinder and a second cylinder fixedly connected between the first handle and the first piston. A second piston is movably received in the second cylinder and a rod is connected to the second piston. The rod extends through the first handle and connected to second handle which is disengagably connected to the first handle. The movement of the first piston is used to pump tires and the movement of the second piston is used to pump a cylinder of air suspension device.

6 Claims, 6 Drawing Sheets

COMBINED BICYCLE TIRE AND AIR SUSPENSION PUMP WITH REMOVABLE PRESSURE GAUGE

FIELD OF THE INVENTION

The present invention relates to a pump which can be used to pump bicycle tires and air suspension cylinders.

BACKGROUND OF THE INVENTION

A conventional air suspension device is a cheap but effective way to absorb shocks transferred from the rugged road to the bicycle frame. The air suspension device basically is a cylinder in which a piston is movably received in the cylinder so that when shocks are transferred to the bicycle frame, the piston is moved to compress the air in the cylinder. By the compressibility of the air in the cylinder, the shocks can be absorbed and the rider feels comfortable when ridding on a rugged road. Nevertheless, it is a problem for the riders to pump the cylinder to provide enough pressure in the cylinder. Generally, the riders have to pump their cylinders in a bicycle store by specially designed machine. Although a tire pump is become a standard equipment for a bicycle, the requirements for pumping tires and for pumping the cylinders of suspension device are different. The pressure in tires is lower than that in the cylinders of suspension device. The tire pump can only provide lower pressure and large volume of air into the tire. The valve of the tire pump cannot bear a larger pressure as that is used for the cylinders of suspension device.

The present invention intends to provide a pump that has an inner cylinder connected to a piston in the cylinder of the pump and the two cylinders can be operated in separate so that the pump can be used to pump tires and cylinders of suspension device.

SUMMARY OF THE INVENTION

In accordance with one aspect of the present invention, there is provided a pump and comprising a first cylinder with a first valve member connected to a first end of the first cylinder and a first handle disengagably connected to a second end of the first cylinder. A first piston is movably received in the first cylinder and a first aperture is defined in a first end of the first piston. A second cylinder is fixedly connected between the first handle and a second end of the first piston. A second piston is movably received in the second cylinder and a rod is connected to the second piston. The rod movably extends through the first handle and connected to a second handle which is disengagably connected to the first handle.

The object of the present invention is to provide a dual-function pump that can be used to pump bicycle tires by a first cylinder and to pump a cylinder of an air suspension device by a second cylinder received in the first cylinder.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
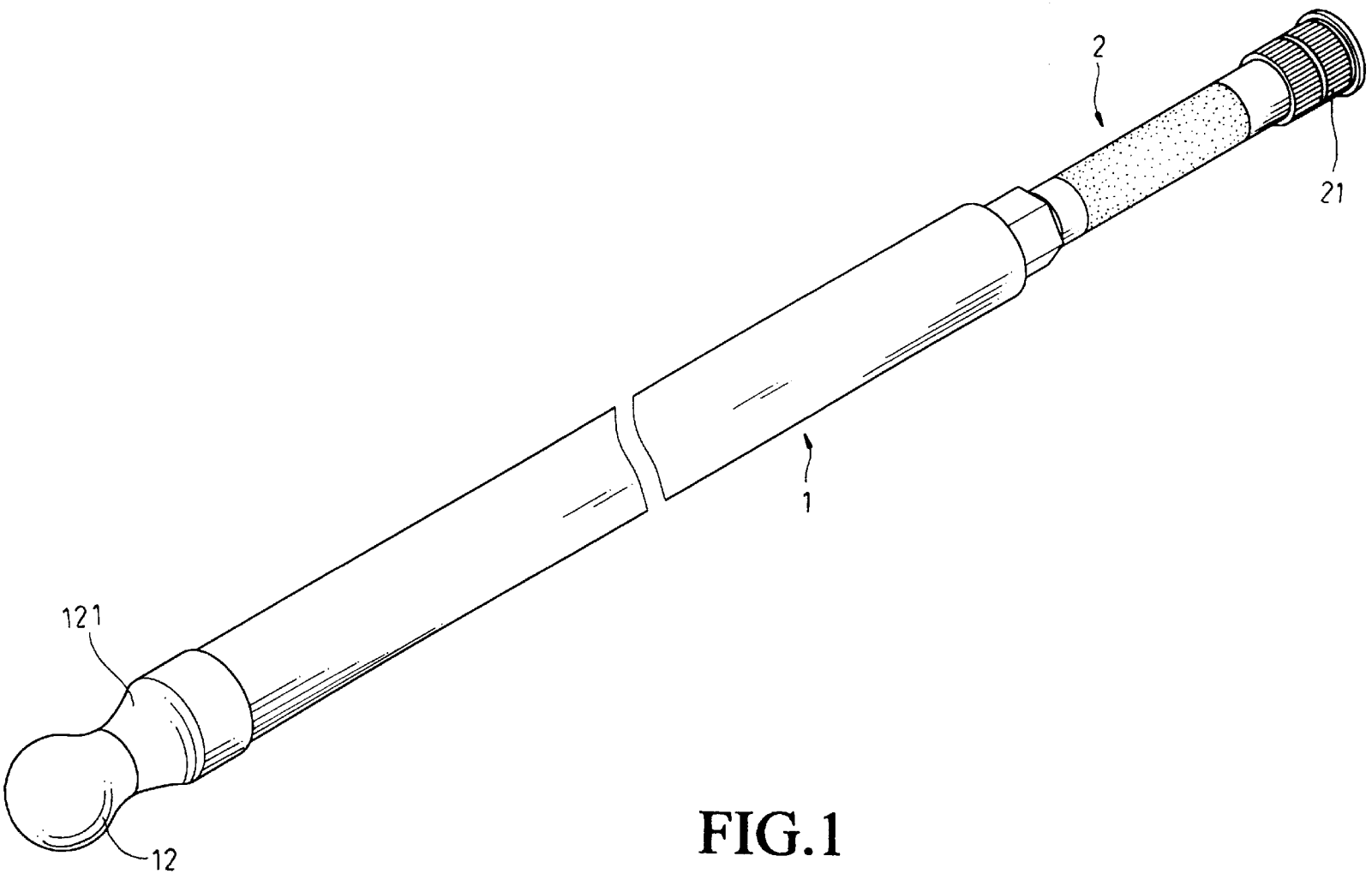
FIG. 1 is a perspective view to show the pump in accordance with the present invention.
Figure 2:
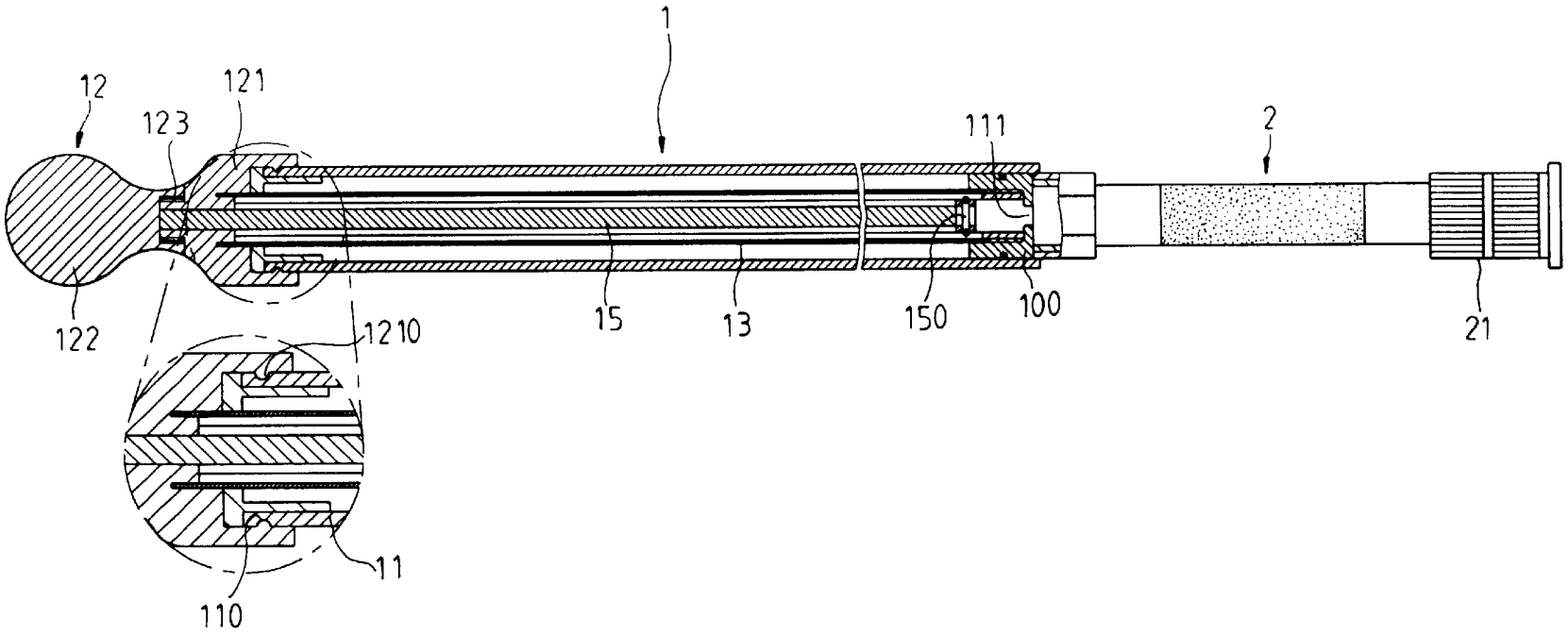
FIG. 2 is a side elevational view, partly in section, of the pump in accordance with the present invention.
Figure 3:
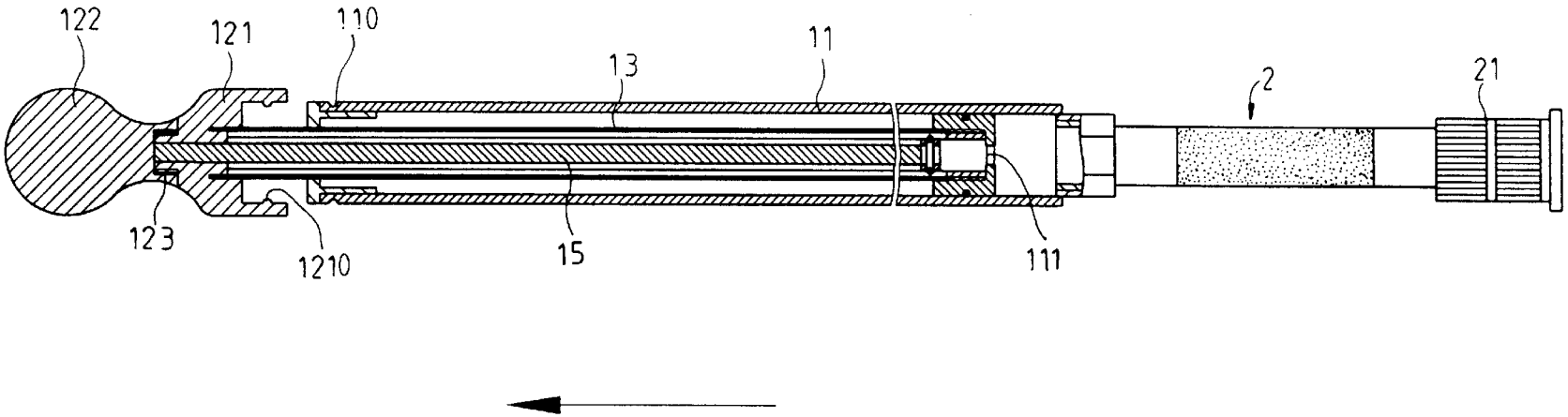
FIG. 3 is a side elevational view, partly in section, of the pump in accordance with the present invention, wherein the first piston is moved by pulling the second cylinder from the first cylinder.
Figure 6:
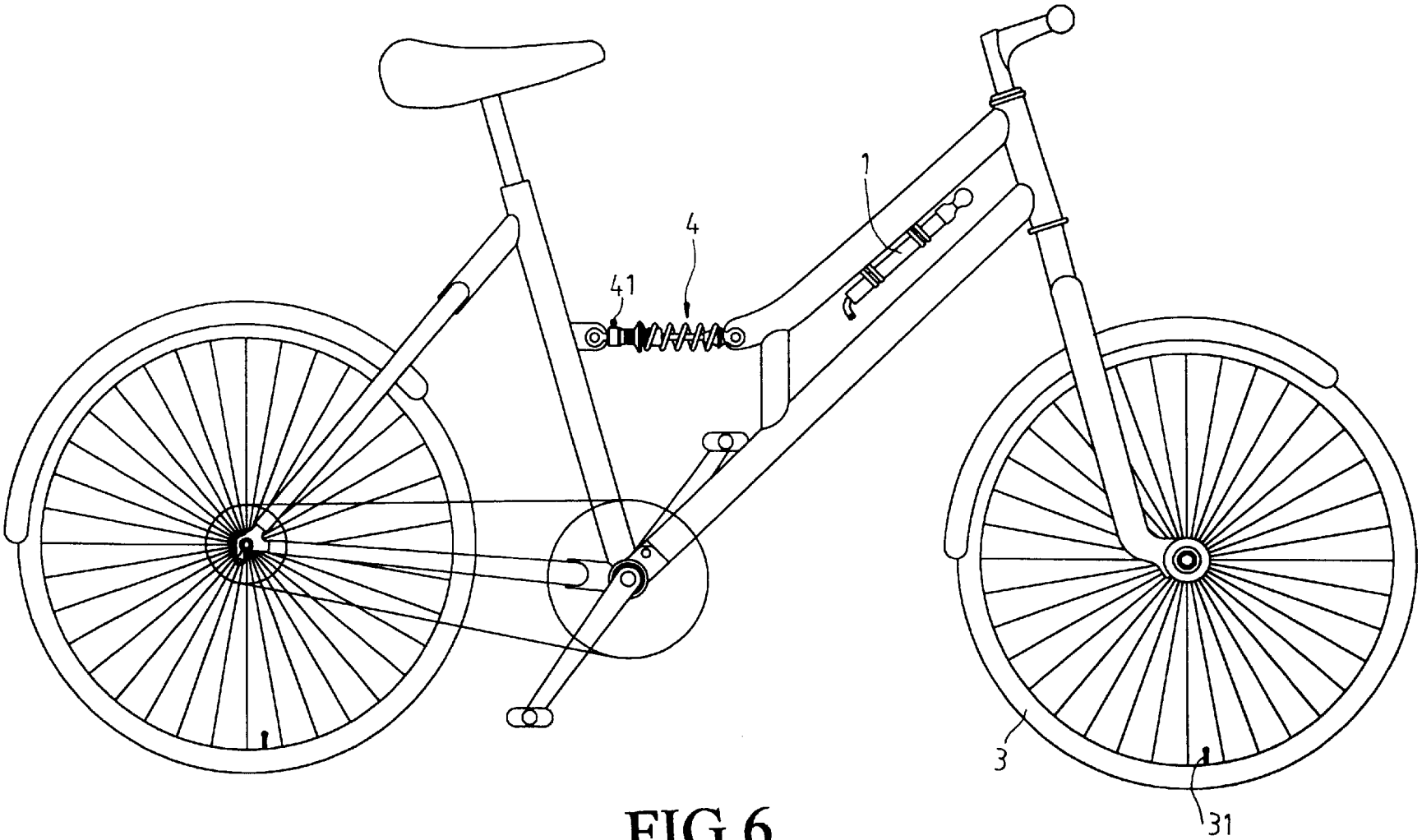
FIG. 6 is a side view to show the pump of the present invention is connected to a bicycle frame which has an air suspension device.

Referring to FIGS. 1, 2 and 6, the pump 1 in accordance with the present invention comprises a first cylinder 11 which has an extension section 2 connected to a first end of the first cylinder 1 and a first valve member 21 is connected to the extension section 2. The first valve member 21 can be engaged with a valve 31 of a tire 3 and a valve (not shown) of a cylinder 41 of an air suspension device 4 for the bicycle as shown in FIG. 6. A first handle 12 is disengagably connected to a second end of the first cylinder 11, wherein the first handle 121 has an annular flange 1210 extending from an inside thereof and a groove 110 is defined in an outside of the second end of the first cylinder 11. The flange 1210 is disengagably engaged with the groove 110 so that the first handle 121 can be separated from the first cylinder 11 as shown in FIG. 3. A first piston 100 is movably received in the first cylinder 11 and a first aperture 111 is defined in a first end of the first piston 100.

A second cylinder 13 is fixedly connected between the first handle 12 and a second end of the first piston 100. A second piston 150 is movably received in the second cylinder 13 and a rod 15 is connected to the second piston 150. The rod 15 movably extends through the first handle 121 and is connected to a second handle 122. The second handle 122 is a spherical knob and is disengagably connected to the first handle 121 by a connection means 123. It is to be noted that a neck portion is connected between the first handle 121 and the second handle 122 so that a user conveniently holds the neck portion to pull the combination of the first handle 121 and the second handle 122.

As shown in FIG. 3, when the pump 1 is used as a tire pump, the first handle 121 together with the second handle 122 are pulled to disengage from the first cylinder 11 and the second cylinder 13 is moved with the first handle 121. The first piston 100 is therefore moved in the first cylinder 11. Air in the first cylinder 11 can be pushed by the first piston 100 when pushing the second cylinder 13 toward the first valve member 21.

Figure 4:
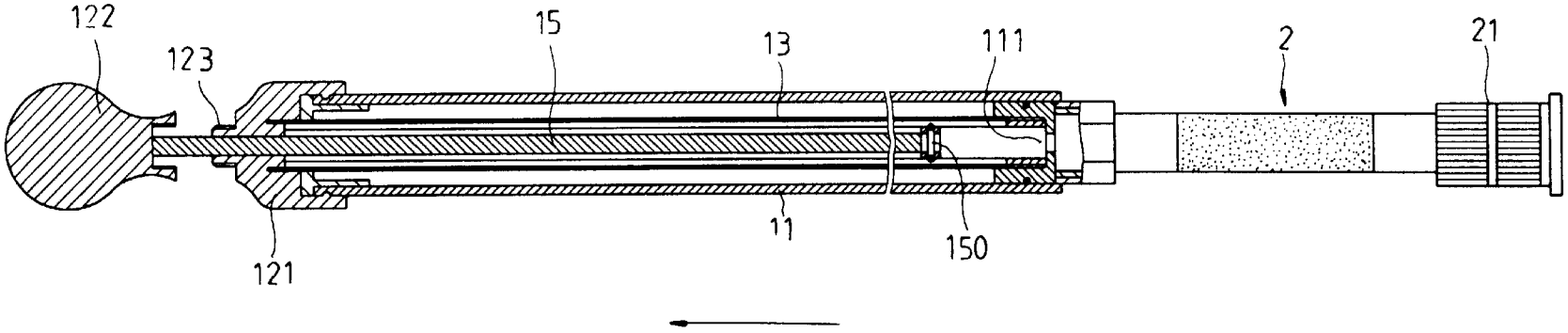
FIG. 4 is a side elevational view, partly in section, of the pump in accordance with the present invention, wherein the second piston is moved by pulling the rod in the second cylinder which is securely received in the first cylinder.

As shown in FIG. 4, when the pump 1 is used to pump the cylinder 41 of an air suspension device 4, the second handle 122 is disengaged from the first handle 121 and the second handle 122 together with the rod 15 are pulled away from the first cylinder 11. The second piston 150 is then moved in the second cylinder 13 and air in the second cylinder 13 can be compressed to pass through the aperture 111 in the first piston 11 and enters the cylinder 41 via the first valve member 21.

Figure 5:
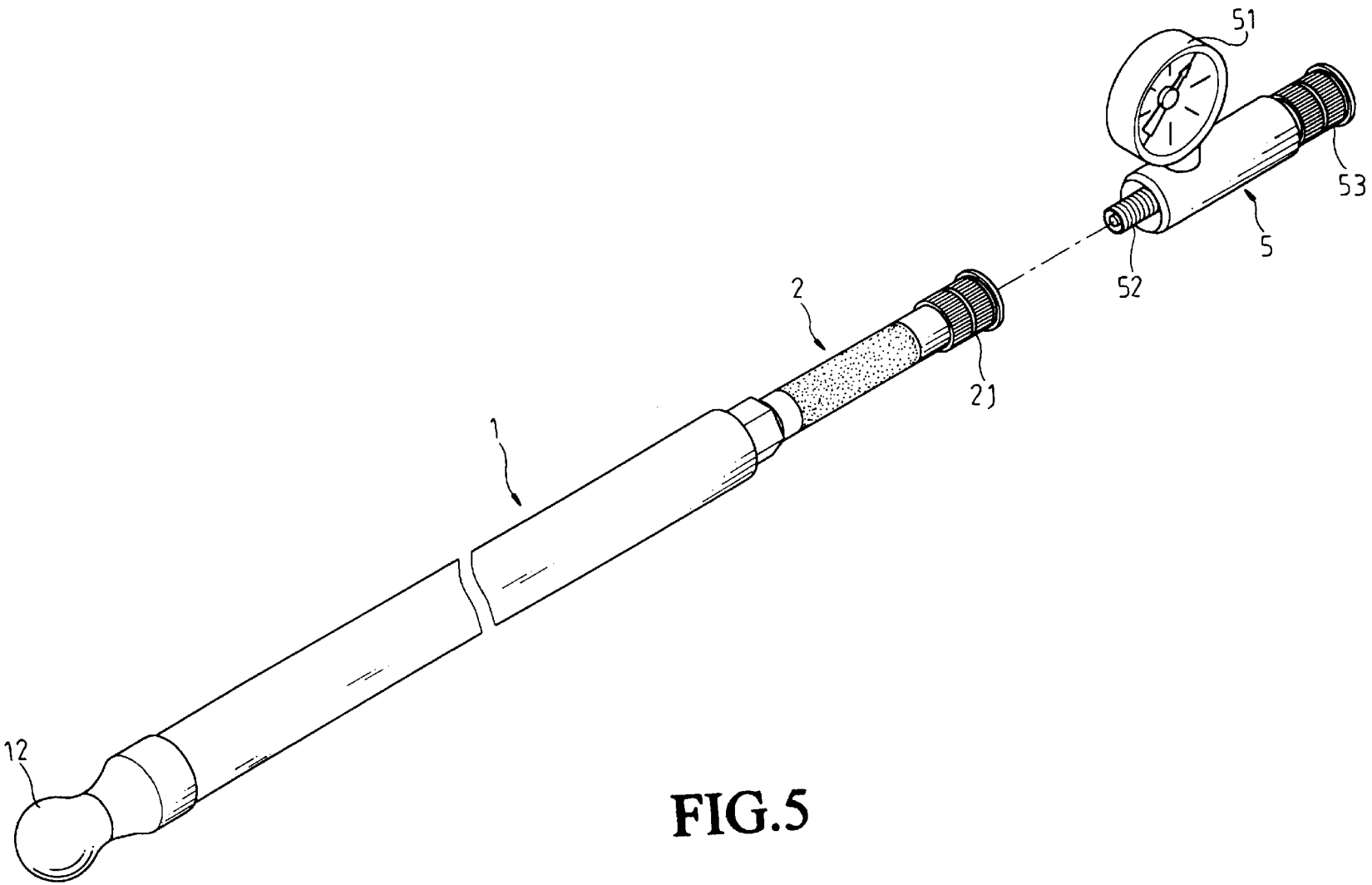
FIG. 5 is an exploded view to show an auxiliary section is connected to the pump in accordance with the present invention.

FIG. 5 shows that an auxiliary section 5 has a connection member 52 to be connected to the first valve member 21 and a second valve member 53 is connected to a distal end of the auxiliary section 5. A pressure gauge 51 is connected to the auxiliary section 5 so that the air pressure can be read from the pressure gauge 51 when operating the pump 1.

While we have shown and described various embodiments in accordance with the present invention, it should be clear to those skilled in the art that further embodiments may be made without departing from the scope and spirit of the present invention.

What is claimed is:

1. A pump comprising:

a first cylinder;

a first valve member connected to a first end of said first cylinder and a first handle disengagably connected to a second end of said first cylinder;

a first piston movably received in said first cylinder and a first aperture defined in a first end of said first piston;

a second cylinder fixedly connected between said first handle and a second end of said first piston, a second piston movably received in said second cylinder and a rod connected to said second piston, said rod movably extending through said first handle, and a second handle directly and disengagably connected to said first handle and connected to said rod.

2. The pump as claimed in claim 1, wherein said first handle has an annular flange extending from an inside thereof and a groove defined in an outside of said second end of said first cylinder, said flange disengagably engaged with said groove.

3. The pump as claimed in claim 1 further comprising an extension section extending from said first valve member and said extension section connected to said first end of said first cylinder.

4. The pump as claimed in claim 1 further comprising an auxiliary section connected to said first valve member and a second valve member connected to a distal end of said auxiliary section, a pressure gauge connected to said auxiliary section.

5. The pump as claimed in claim 1 further comprising a neck portion connected between said first handle and said second handle.

6. The pump as claimed in claim 5, wherein said second handle is a spherical knob.

* * * * *